US009364949B2

(12) United States Patent
Ernst

(10) Patent No.: US 9,364,949 B2
(45) Date of Patent: Jun. 14, 2016

(54) SOCKET RAIL AND TRAY

(71) Applicant: Gregory R Ernst, Eagle Creek, OR (US)

(72) Inventor: Gregory R Ernst, Eagle Creek, OR (US)

( * ) Notice: Subject to any disclaimer, the term of this patent is extended or adjusted under 35 U.S.C. 154(b) by 118 days.

(21) Appl. No.: 14/076,010

(22) Filed: Nov. 8, 2013

(65) Prior Publication Data

US 2014/0190853 A1 Jul. 10, 2014

Related U.S. Application Data

(60) Provisional application No. 61/724,708, filed on Nov. 9, 2012.

(51) Int. Cl.
*B25H 3/06* (2006.01)
*B65D 85/20* (2006.01)

(52) U.S. Cl.
CPC . *B25H 3/06* (2013.01); *B65D 85/20* (2013.01)

(58) Field of Classification Search
CPC ..... B25H 3/06; B25H 3/04; B25H 3/003; B65D 85/20
USPC ..... 206/560, 565, 493, 443
See application file for complete search history.

(56) References Cited

U.S. PATENT DOCUMENTS

| | | | | |
|---|---|---|---|---|
| 4,927,020 | A | 5/1990 | Randy | |
| 5,284,345 | A | 2/1994 | Jehn | |
| 5,560,480 | A | 10/1996 | Singleton | |
| 5,743,375 | A | 4/1998 | Shyr et al. | |
| 5,931,299 | A * | 8/1999 | Hsieh | 206/376 |
| D426,061 | S | 6/2000 | Naegele et al. | |
| 6,126,004 | A * | 10/2000 | Ling | 206/377 |
| 6,145,662 | A | 11/2000 | Newton | |
| 6,364,109 | B1 | 4/2002 | Blackwell | |
| 6,431,373 | B1 | 8/2002 | Blick | |
| 6,488,151 | B2 | 12/2002 | Ramsey et al. | |
| D478,210 | S | 8/2003 | Dembicks | |
| 6,637,605 | B2 | 10/2003 | Ernst | |
| 2003/0019775 | A1 * | 1/2003 | Ernst | 206/378 |
| 2003/0080076 | A1 * | 5/2003 | Hu | 211/70.6 |
| 2003/0234196 | A1 * | 12/2003 | Hu | 206/372 |
| 2007/0023369 | A1 * | 2/2007 | Lin | 211/70.6 |

* cited by examiner

*Primary Examiner* — Anthony Stashick
*Assistant Examiner* — Robert Poon
(74) *Attorney, Agent, or Firm* — patenttm.us

(57) ABSTRACT

A socket rail tray receives socket rails therein in releasable locking engagement. A slide-click-lock function is provided to lock the rail to the tray, and depressing a release button allows the rail to be removed from the tray. Both ends of the rail as well as a central portion thereof are secured by the tray.

3 Claims, 9 Drawing Sheets

SOCKET RAIL AND TRAY

CROSS-REFERENCE TO RELATED APPLICATIONS

This application is a non-provisional of U.S. provisional patent application 61/724,708 filed Nov. 9, 2012.

BACKGROUND OF THE INVENTION

This invention relates to tools, and more particularly to a socket rail and tray for holding sockets.

Rails that hold one or more sockets thereon for ease of storage and transportation are commonly used. The rail receives multiple socket engaging clip members, whereby individual sockets are attached to clips, allowing storage of sockets when not in use. An example of such a socket rail and clips is shown in U.S. Pat. No. 6,637,605, entitled WRENCH SOCKET STORAGE RAIL.

The base preferably includes plural rows of finely spaced apart serrations extending substantially the length of the base or rail. Each wrench socket holder defines a bite area in which is received a segment of the base. Legs on each holder partially define the bite area of each socket holder. The legs may flex to permit snapping of the holder onto or off of the base or rail to permit adding holders to or subtracting holders from the rail without disturbing the placement of other holders already on the rail. An inwardly extending projection on a leg of a holder seats intermediate adjacent serrations to prevent shifting of the holder until intentionally repositioned. Multiple pairs of serrations on front and rear sides of the rail permit rows of wrench holders to add to socket holder capacity of a rail.

Such rails can be unwieldy to handle at times, especially when fully populated with sockets. It would be desirable to have an easy way to store and transport one or more set of rails, while allowing easy removal of an individual rail for ease of access to the sockets and transporting of a subset of sockets to a work site.

SUMMARY OF THE INVENTION

In accordance with the disclosure, an improved socket rail and tray are provided for storage of sockets.

Accordingly, it is an advantage of the present disclosure to provide an improved socket rail and tray to enable storage of sockets.

It is a further advantage of the present disclosure to provide an improved socket rail system that enables easy transfer and storage of sockets.

It is yet another advantage of the present disclosure to provide an improved socket rail and tray that allows easy access and storage of sockets.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

The system according to a preferred embodiment of the present disclosure comprises a tray member adapted to receive one or more socket rails therein, in a disengagable fashion. The tray includes shoulder guides that engage with ends of the rails and a swedged head member that engages a corresponding slot in the rail. A lock member provides an audible click on locking, to provide feedback to the user to know that the rail is engaged to the tray. The configuration allows a 'push-click-slide' type operation to engage the rail with the tray member, and an easy release mechanism for disengaging a rail from the tray.

Figure 1:
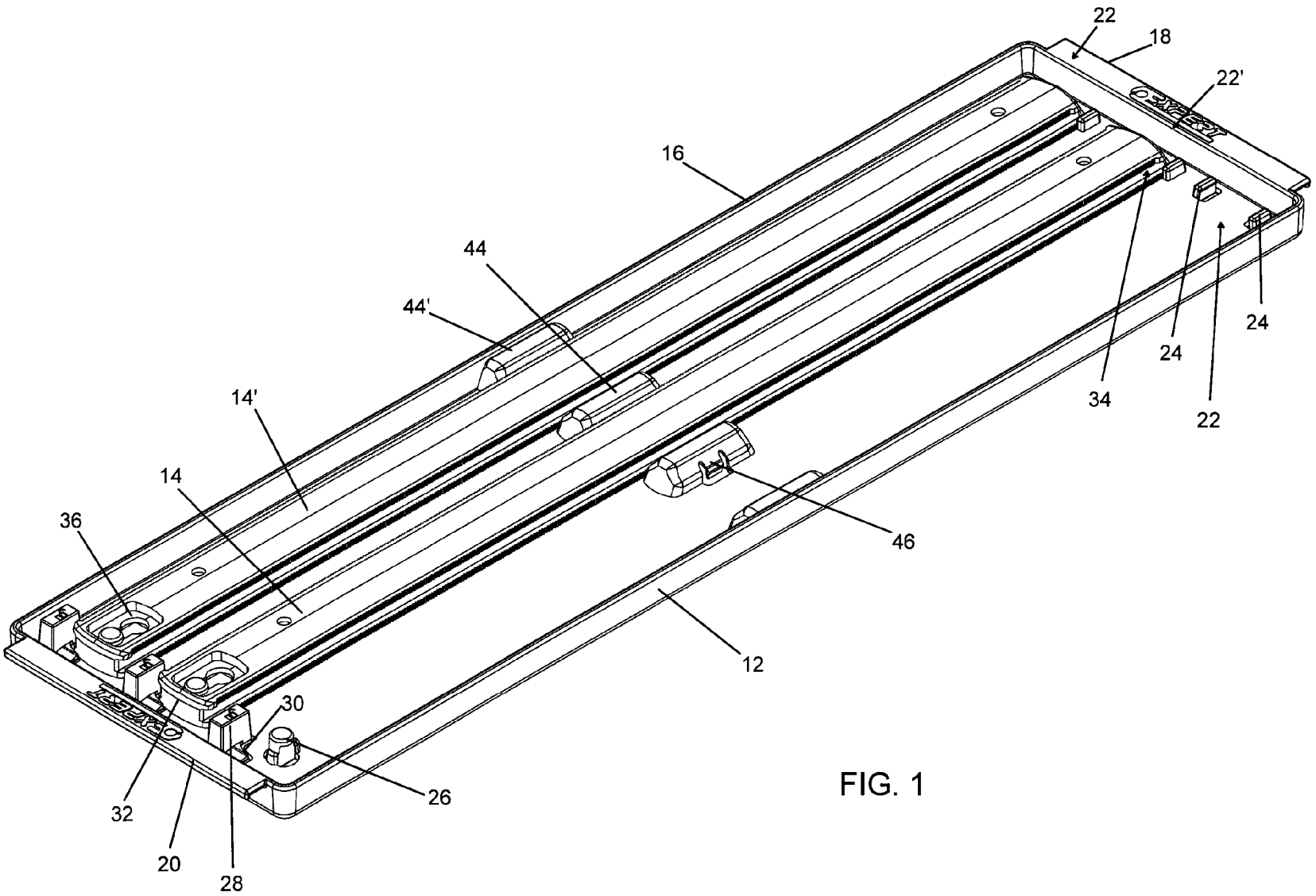
FIG. 1 is a perspective view of a socket tray with 2 rails mounted thereon, and one rail receiving position open.

Referring to FIG. 1, a perspective view of a socket tray 12 with 2 rails 14, 14' mounted thereon, and one rail receiving position open, the tray is suitably rectangular in overall shape, with elevated side members 16, 18 and end handle portions 20 for ease in carrying or moving the tray. At one end of the tray, 3 rail receiving positions 22, 22' and 22" are defined, comprising pairs of engaging clip members 24, an individual pair of clips 24 being spaced apart a sufficient distance to receive and end portion of a rail 14 therein.

At the opposite end of the tray 12, a swedged peg member 26 is provided centrally of a rail receiving zone, and a deformable lock member 28 is positioned at an edge of the rail receiving zone, for removably locking a rail into place in the tray as discussed hereinbelow.

Deformable lock member 28 is suitably a 3-dimensional rectangular shaped member that is adapted to be depressed downwardly into the face of the tray, but biased to return to an undepressed position, with an engaging shoulder portion 30 defined along an interior edge thereof, shoulder portion having a curved edge profile that matches a curved edge profile 32 of an end of a socket rail.

The individual sides of clip pair 24 are spaced from one another a sufficient distance to receive corresponding shoulder portions 34, 34' defined in the end of rail 14 opposite from the end carrying curved edge profile 32, providing a slidable engagement profile into which the end of a rail 14 may be slided.

Figure 9:
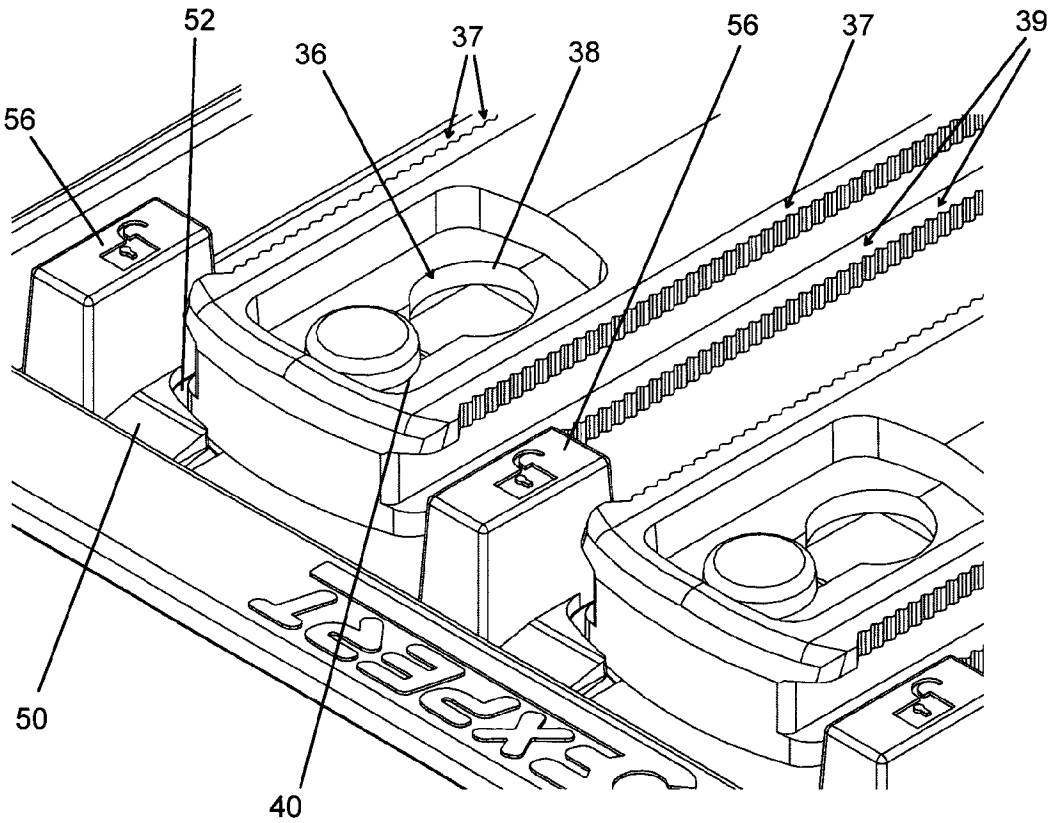
FIG. 9 is an enlarged view of a rail end locked in place.

Additionally formed at the end of the rail carrying shoulder portions 34, 34', is an engagement slot 36 having a keyhole shape with a larger portion 38 formed inwardly with respect to the length of rail 14, transitioning to a narrower straight edged portion 40 as the slot extends more towards the outer end of the rail (FIG. 9). The rails suitably have serrated edges 37, 39 along the upper and lower side edges.

Centrally positioned on the surface of tray 12 is central region clip 44 which comprises left and right flexible shoulder engaging leaves 46, 46'. Leaves 46 are adapted to engage with the shoulder portion of rail 14, to assist in holding the central part of the rail to the tray when the rail is installed to the tray. The flexing configuration of the leaves enables the central portion of the rail to be pressed downwardly from above the leaves into engagement, or alternatively, the rail can be threaded through the leaves from below when sliding into engagement.

Swedged peg member 26 has flat lateral sides below the swedged portion (the swedged portion being an upper portion to the peg member that is of wider diameter than lower portions of the peg member), defining a size so as to closely engage in sliding fashion the region 40 of keyed region 36 in the rail.

To install a rail into the tray, a 'push-click-slide' type operation is typically performed, wherein the rail is moved toward the tray, opening 38 is positioned over swedged peg member 26 as the rail is lowered to mate with the face of the tray and the general central portion of the rail is pushed downwardly against the central clip 44 until the rail engages the flexible shoulder engaging leaves 46, 46', with a click sound, whereupon the rail is slided in the direction of arrow 42 until swedged peg member 26 engages with keyed region 36 and 40 and shoulder 30 engages with the end of the rail.

Simultaneously, the shoulder portions 34, 34' of the rail are slided into engagement with an individual clip pair 24. The bottom edge of the rail 14 rides over the upper surface of engaging shoulder portion 30, until such time as the distal end of the rail passes beyond shoulder portion 30, whereupon the bias of the shoulder portion causes it to move upwardly, whereby the edge of the shoulder portion blocks the rail from moving backwardly.

Figure 2:
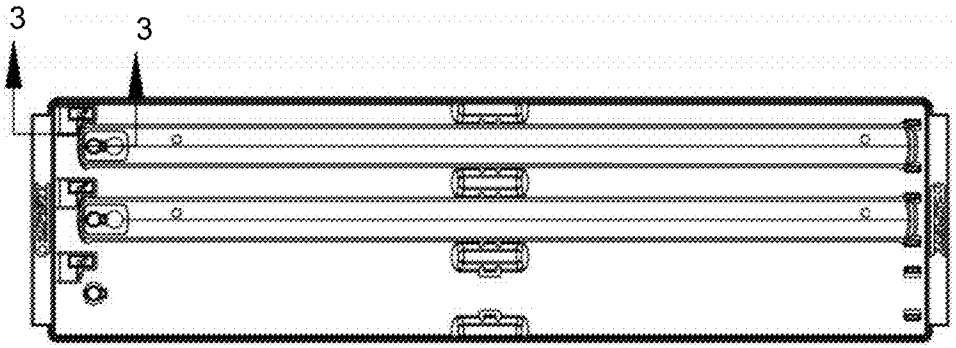
FIG. 2 is a top view of the socket tray.
Figure 3:
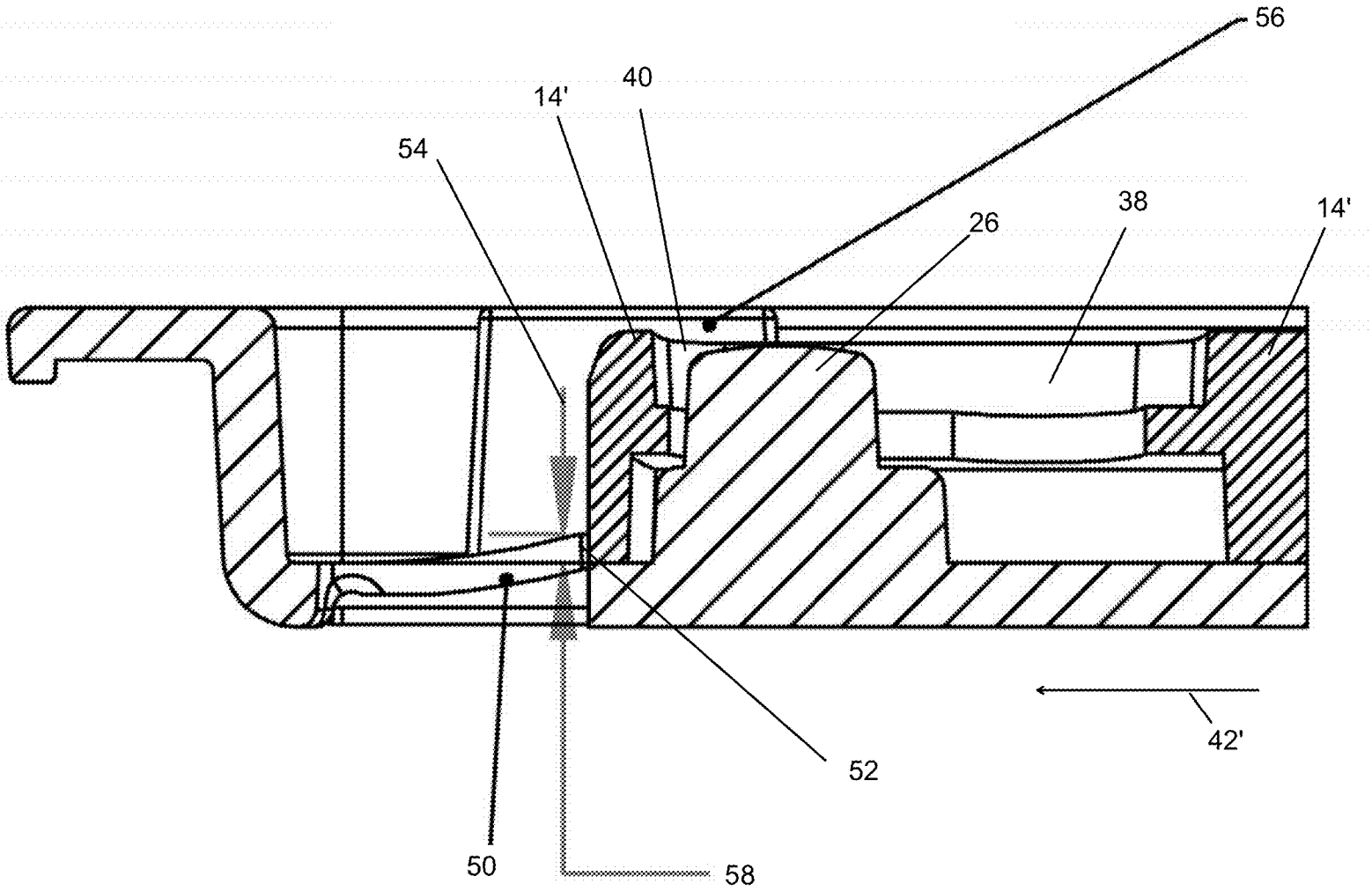
FIG. 3 is a sectional view taken along line 3-3 of FIG. 2.

Referring to FIG. 2, a top view of the tray with 2 rails installed, and FIG. 3, a sectional view taken along line 3-3 of FIG. 2, the locking mechanism comprises a flex arm 50 with a locking edge 52 that, when the rail is installed, abuts against the distal edge of the rail 14', locking it into position, until such time as the flex arm is pushed down in the direction of arrow 54, by depressing button portion 56 formed as an upwardly extending portion of one edge of the locking edge 52, resulting in downward flexing of the forward edge portion 58 of the flex arm, which then allows the rail 14' to be moved in the direction of arrow 42' such that the swedged portion of peg member 26 moves from region 40 of the opening 36 to the wider region 38, allowing the rail to be disengaged from interaction with the swedged region, ultimately allowing the rail end to be raised off of engagement with the swedged peg and out of the tray. Simultaneously with the movement in direction 42', the opposite end of the rail disengages with lock members 24' as discussed below.

Figure 4:
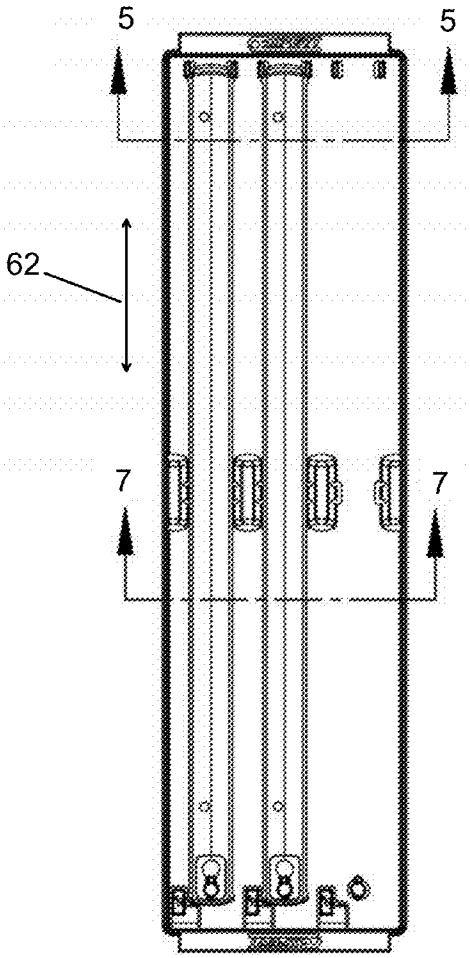
FIG. 4 is another top view of the socket tray
Figure 5:
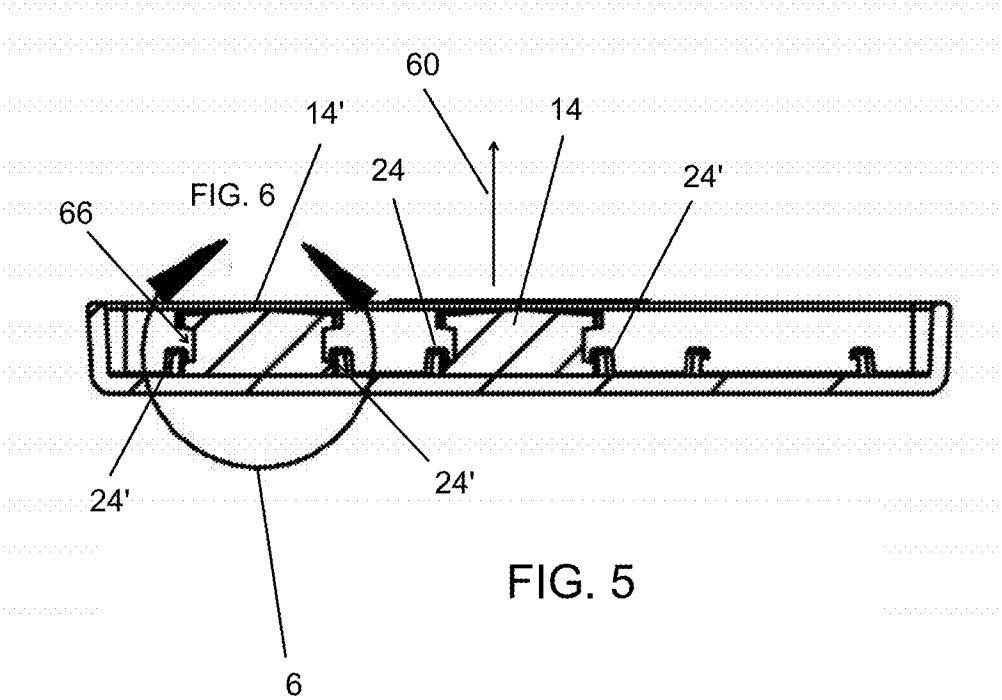
FIG. 5 is a sectional view taken along line 5-5 of FIG. 4.
Figure 6:
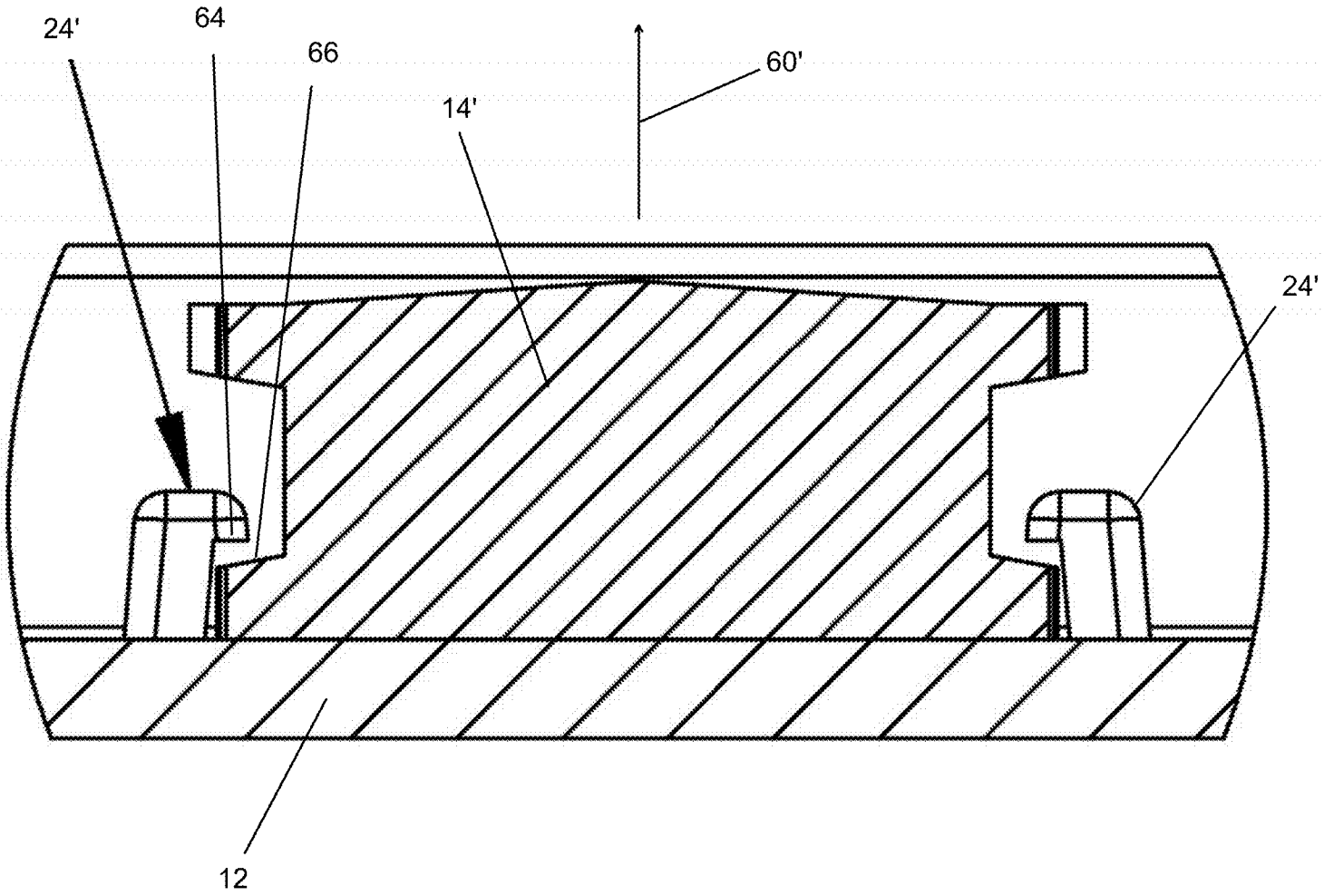
FIG. 6 is an enlarged view of a portion of FIG. 5.

FIG. 4 is a further top view of a tray with 2 rails installed, and FIG. 5 is a sectional view taken along line 5-5 of FIG. 4, wherein it may be observed that the rail has a profile defining a lower outwardly extending shelf portion 66 adapted to engage with clip members 24, to slidingly receive the rail 14 between members 24, capturing the rail against upward movement in the direction of arrow 60 (FIG. 5, FIG. 6) while still allowing sliding movement in the directions of arrow 62 (FIG. 4). FIG. 6, a more detailed view of the region of arrow 5 in FIG. 5, illustrates the overhanging ledge member 64 of the lock member 24', and the counterpart shelf region 66 of the rail 14', portions 64 and 66 cooperating to prevent more than just a slight upward movement of the rail 14' in the direction of arrow 60'.

Figure 7:
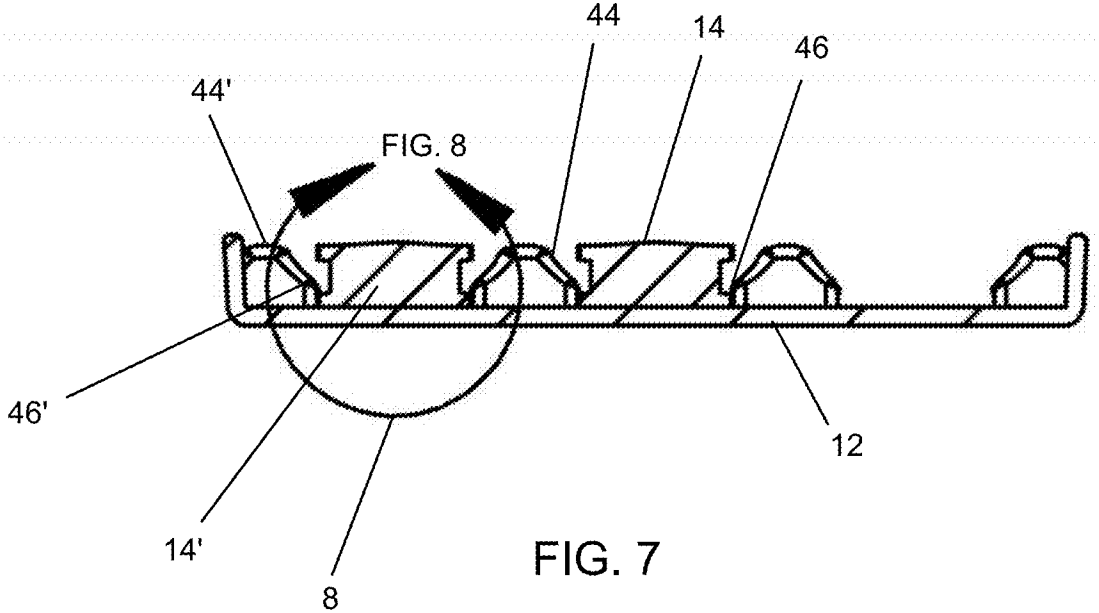
FIG. 7 is a sectional view taken along line 7-7 of FIG. 4.
Figure 8:
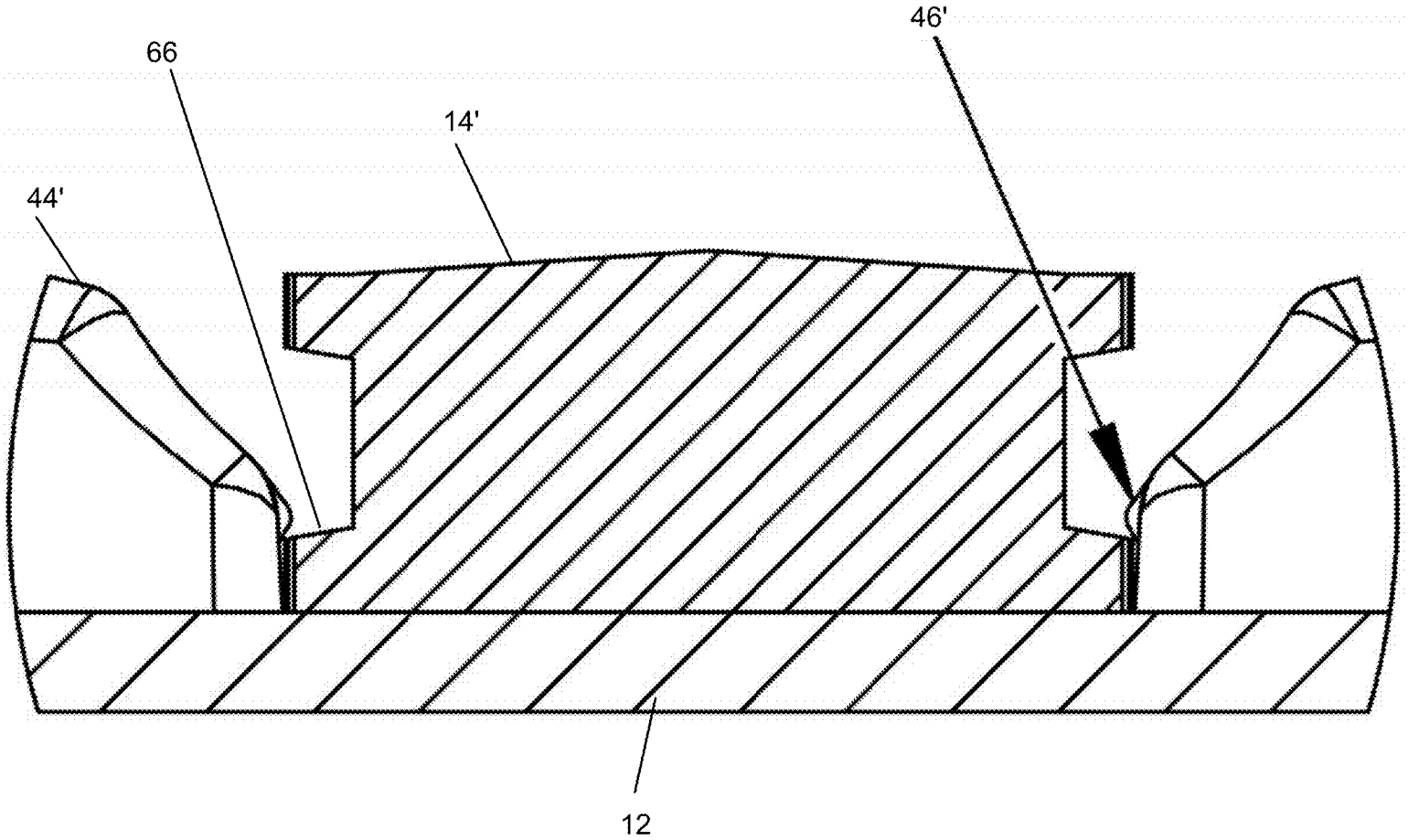
FIG. 8 is an enlarged view of a portion of FIG. 7.

Referring now to FIG. 7, a sectional view taken along line 7-7 of FIG. 4, and FIG. 8, and enlarged view of the area of arrow 8 of FIG. 4, the central region of the rail is received by receiving clips 44, which by use of leaves 46' of central region clips 44', a removable engagement is made with the shelf region 66 of the rail 14', with a slight click sound being provided upon engagement.

Thus, in use, to install a rail 14 on the tray 12, the user moves the rail 14 towards the tray, guiding the rail to fit between portions 44, aiming to have the opening 36 positioned above the swedged peg 26. The central portion of the rail may now be pushed downwardly until a slight click confirms engagement of flexible shoulder engaging leaves 46 with the shelf region 66 of the rail. The rail may now be slided in the direction of arrow 42, whereupon the end of the rail distal from engagement slot 36 is captured by engaging clip members 24. Substantially simultaneously with the engagement by clip members 24, at the opposite end of the rail, swedged peg 26 is received by engagement slot 36, and travels into the narrower portion 40 of the slot, to lock the end of the rail against movement away from the surface of the tray in the direction of arrow 60. At the same time, the lower surface of the rail is depressing flex arm 50 downwardly in the direction of arrow 54, until such time as the trailing edge of the rail passes beyond locking edge 52 of the flex arm, whereupon the spring action of the arm causes the arm to move upwardly, whereupon locking edge 52 abuts the distal vertical face of the rail and now blocks the rail from sliding in the direction of arrow 42'. By this operation, the rail is now locked to the tray.

To remove the rail from the tray, the user depresses button portion 56 downwardly, which lowers the locking edge 52 of the flex arm below the bottom face of the rail, allowing the rail to be slided over the top of the flex arm, and, in the reverse of the installment steps, the rail can be lifted from the tray, as the engaging clip members 24 no longer are interacting with the end of the rail opposite the location of button 56, and the shoulder engaging leaves 46 are sufficiently loosely engaged with the rail to allow easy dis-engagement.

Figure 10:
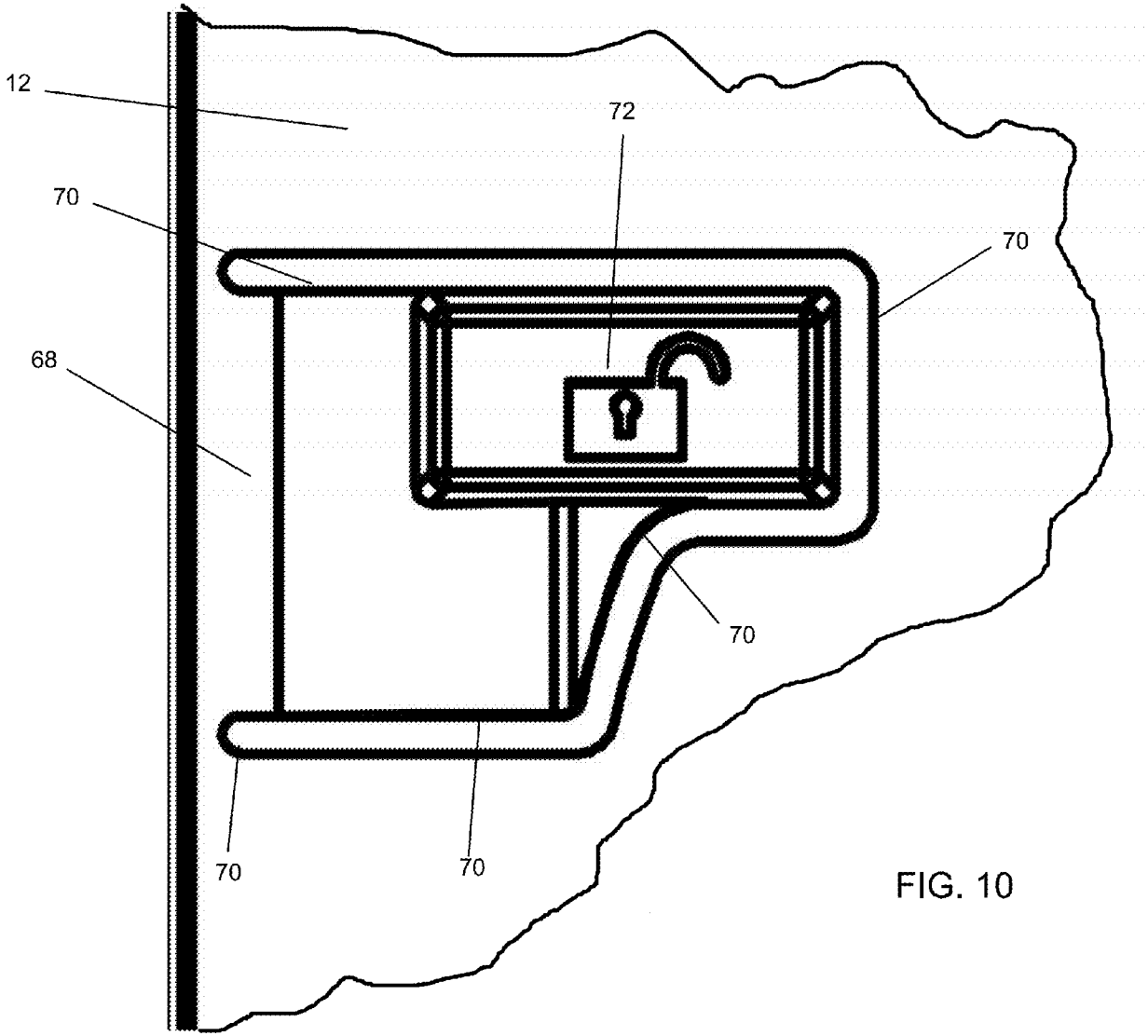
FIG. 10 is a top view of a portion of the tray illustrating the formation of flex arm 50 and button member 56.

FIG. 10 is a top view of a portion of the tray illustrating the formation of flex arm 50 and button member 56, wherein it can be observed that the left edge 68 of the flex arm/button in the illustration is attached/formed as a part of the tray bottom 12, while a peripheral slot 70 is formed around the rest of the flex arm/button, providing a flexible feature to the arm and button allowing the arm/button to flex into and out of the plane of the bottom surface face of the tray. A lock graphic 72 is suitably formed in the top of the button, as a reminder/indicator of the locking feature provided.

The tray is suitably formed from plastic in a preferred embodiment, making for easy production. The corresponding rails are also suitably formed from a plastic.

Accordingly, a socket rail receiving tray is provided, that easily accommodates one or more socket rails, while allowing easy storage or removal of the rail from the tray for access to the sockets or sets of sockets. A press-click-slide-click/lock configuration is enabled by the configuration, providing audible feedback to the user to indicate that the rail has been secured. Easy removal of the rail is enabled by pressing a lock release button, allowing the rail to be slided out of engagement with the tray.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A socket storage system, comprising:

a socket rail for mounting at least one socket thereto for storage and/or transport of the at least one socket;

a tray member for receiving the socket rail therein; and a locking mechanism for releasably securing the socket rail to the tray member, wherein said locking mechanism comprises a rail central engaging mechanism for engaging the rail at a central region thereof and a peg member having an upper and a lower portion, where said upper portion has a wider diameter than said lower portion and said rail comprises a key slot portion for interacting with said peg member upper portion to releasably secure said rail to the tray member wherein said locking mechanism comprises:

a rail end engaging member for engaging an end of the rail, further comprising a locking mechanism for locking said rail into engagement with said tray member, wherein said locking mechanism comprises a depressible lock member over which said rail slides until in a locked position, whereupon said lock member moves to a non-depressed state to interact with an edge of said rail member to block movement of said rail to a released position.

2. A socket storage system, comprising:

a socket rail for mounting at least one socket thereto;

a socket rail engaging clip for receiving the socket rail therein, said socket rail engaging clip engaging the socket rail on pushing the socket rail into the clip and providing engagement against unintended removal of the socket rail from the first socket rail engaging clip in a direction of a first axis, while allowing sliding of the socket rail in a second axis; and a socket rail engaging member for releasably engaging said socket rail against sliding of the socket rail in the second axis upon sliding of said socket rail in the second axis, further comprising a releasable lock member for locking said socket rail against unintended sliding in the second axis, wherein said lock member comprises a depressible member with a socket rail engaging member that depresses while said socket rail is sliding in a range of first positions but expands to engage said socket rail engaging member with said socket rail when said socket rail slides to a second position.

3. The socket storage system according to claim 2, comprising three said socket rails, three said first socket rail engaging clips and three said second socket rail engaging members, for simultaneously storing said three socket rails adapted to mount one or more sockets thereto.

* * * * *